US007193576B2

(12) United States Patent
Yazdandoost et al.

(10) Patent No.: US 7,193,576 B2
(45) Date of Patent: Mar. 20, 2007

(54) ULTRA WIDEBAND BOW-TIE SLOT ANTENNA

(75) Inventors: Kamya Yekeh Yazdandoost, Tokyo (JP); Ryuji Kohno, Tokyo (JP)

(73) Assignee: National Institute of Information and Communications Technology, Koganei (JP)

( * ) Notice: Subject to any disclaimer, the term of this patent is extended or adjusted under 35 U.S.C. 154(b) by 0 days.

(21) Appl. No.: 11/023,454

(22) Filed: Dec. 29, 2004

(65) Prior Publication Data

US 2005/0184919 A1 Aug. 25, 2005

(30) Foreign Application Priority Data

Feb. 19, 2004 (JP) ..... 2004-043395

(51) Int. Cl.
*H01Q 13/10* (2006.01)
*H01Q 1/38* (2006.01)
*H01Q 21/00* (2006.01)

(52) U.S. Cl. ..... 343/767; 343/700 MS; 343/725

(58) Field of Classification Search ..... 343/700 MS, 343/725, 727, 767, 770, 795
See application file for complete search history.

(56) References Cited

U.S. PATENT DOCUMENTS

| | | | | |
|---|---|---|---|---|
| 2,935,747 | A * | 5/1960 | Ghose | 343/767 |
| 4,607,394 | A * | 8/1986 | Nightingale | 455/327 |
| 6,211,840 | B1 | 4/2001 | Wood et al. | 343/793 |
| 6,429,819 | B1 | 8/2002 | Bishop et al. | 343/725 |
| 6,975,258 | B2 | 12/2005 | Pedersen | 343/795 |
| 2002/0154064 | A1 | 10/2002 | Barnes | 343/770 |
| 2002/0180654 | A1 | 12/2002 | Acher et al. | 343/700 MS |
| 2003/0043084 | A1 | 3/2003 | Egashira | 343/767 |

FOREIGN PATENT DOCUMENTS

| | | | |
|---|---|---|---|
| EP | 1 229 605 | A1 | 8/2002 |
| JP | 06-303010 | A | 10/1994 |
| JP | 2829378 | B2 | 2/1997 |
| JP | 09-246817 | A | 9/1997 |
| JP | 10-293174 | A | 11/1998 |
| JP | 10-335910 | A | 12/1998 |
| JP | 2001-345608 | A | 12/2001 |
| JP | 2002-111208 | A | 4/2002 |
| JP | 2002-135037 | A | 5/2002 |
| JP | 2002-353726 | | 12/2002 |
| JP | 2003-037431 | | 2/2003 |

(Continued)

OTHER PUBLICATIONS

Abdelnasser A. Eldek et al., "Wideband Slot Antennas for Radar Applications", Proceeding of the 2003 IEEE Radar Conference, IEEE, US, May 5, 2003, pp. 79-84, XP010642644.

(Continued)

*Primary Examiner*—Shih-Chao Chen

(57) ABSTRACT

A slot antenna includes an insulation substrate, a metal layer provided on the insulation substrate, a slot formed in the metal layer, and a feeding part connected to the metal layer. The slot is symmetric with respect to a centerline. When an x-y coordinate system is defined on the metal layer so that the y-axis is the symmetric line, the origin is the center of the slot antenna, and the x-axis through the origin is perpendicular to the y-axis, the width of the slot in the direction of the y-axis increasing in proportion to the absolute value of the x-axis.

6 Claims, 16 Drawing Sheets

FOREIGN PATENT DOCUMENTS

| | | | |
|---|---|---|---|
| JP | 2003-78345 | A | 3/2003 |
| JP | 3502945 | B2 | 4/2003 |
| JP | 2003-174315 | A | 6/2003 |
| JP | 2003-283241 | A | 10/2003 |

OTHER PUBLICATIONS

Girish Kumar et al., "Directly Coupled Multiple Resonator Wide-Band Micostrip Antennas," *IEEE Transactions on Antennas and Propagation*, vol. AP-33, No. 6, Jun. 1985. pp. 588-593.

Kin-Lu Wong et al., "Broadband triangular Microstrip antenna with U-shaped slot," *Electronic Letters*, vol. 23, No. 25, Dec. 4, 1997. pp. 2085-2087.

Fan Yang et al., "Wide-Band E-Shaped Patch Antennas for Wireless Communications," *IEEE Transactions on Antennas and Propagation*, vol. 49, No. 7, Jul. 2001. pp. 1094-1100.

Aaron K. Shackelford et al., "Design of Small-Size Wide-Bandwidth Microstrip-Patch Antennas," *IEEE Transactions on Antennas and Propagation*, vol. 45, No. 1, Feb. 2003. pp. 75-83.

Jyh-Ying Chiou, et al., "A Broad-Band CPW-Fed Strip Loaded Square Slot Antenna," *IEEE Transactions on Antennas and Propagation*, vol. 51, No. 4, Apr. 2003. pp. 719-721.

Naftali Herscovici et al., "Circularly Polarized Single-Fed Wide-Band Microstrip Patch," *IEEE Transactions on Antennas and Propagation*, vol. 51, No. 6, Jun. 2003. pp. 1277-1280.

Hisao Iwasaki, "A Circularly Polarized Small-Size Microstrip Antenna with a Cross Slot," *IEEE Transactions on Antennas and Propagation*, vol. 44, No. 10, Oct. 1996. pp. 1399-1401.

Wen-Shyang Chen, "Single-feed dual frequency rectangular Microstrip antenna with square slot," *Electronic Letters*, vol. 34, No. 3, Feb. 5, 1998. pp. 231-232.

U.S. Appl. No. 10/925,926, filed Aug. 26, 2004, Kamya Yekeh Yazdandoost et al., National Institute of Information and Communications Technology.

Office Action from Japanese Patent Office.

D. Mirshekar-Syahkal and D. Wake, "Bow-tie antennas on high dielectric substrates for MMIC and OEIC applications at millemetre-wave frequencies", IEEE Journals, Electronics Letters, vol. 31, Issue 24, Nov. 23, 1995, pp. 2060-2061.

E. A. Soliman et al., "Bow-tie slot antenna fed by CPW", IEEE Journals, Electronics Letters, vol. 35, Issue 7, Apr. 1, 1999, pp. 514-515.

* cited by examiner

FREQUENCY 4GHz, $\phi = 0°$ ,90°

φ = 0° ————————

φ = 90° - - - - - - - - - - - -

FREQUENCY 5 GHz, $\phi = 0°$ ,90°

$\varphi = 0°$ ————

$\varphi = 90°$ - - - - - - - -

FREQUENCY 6 GHz, $\phi = 0°$ ,90°

φ = 0° ————————

φ = 90° ----------

FREQUENCY 7 GHz, $\phi = 0°$ ,90°

$\varphi = 0°$ ————————

$\varphi = 90°$ - - - - - - - - - - - -

FREQUENCY 8 GHz, $\phi = 0°$ ,90°

φ = 0° ————————

φ = 90° - - - - - - - - - - - -

FREQUENCY 9 GHz, $\phi = 0°$ ,90°

φ = 0° ————————

φ = 90° - - - - - - - - - - - -

FREQUENCY 10 GHz, $\phi = 0°$ ,90°

φ = 0° ————

φ = 90° - - - - - - - - - - - -

FREQUENCY 6.8GHz

ULTRA WIDEBAND BOW-TIE SLOT ANTENNA

CROSS-REFERENCE TO RELATED APPLICATIONS

This application is based upon and claims priority to Japanese Patent Application No. 2004-043395 filed Feb. 19, 2004, the contents of which are incorporated herein by reference.

BACKGROUND OF THE INVENTION

1. Field of the Invention

Antenna performance and size cause a large impact on the development of wireless devices. Moreover, development of wireless devices greatly depends on improvement of antenna characteristics and size. Designing a traditional antenna that provides fine typical parameters like bandwidth, efficiency and gain within a limited antenna volume is extremely hard. Antenna design is even more critical in devices using the ultra wideband frequency range ("UWB") because communication in UWB systems uses very high data rates and low power densities.

2. Description of the Related Art

Printed antennas are extensively used in various fields due to their many advantages such as their low profile, light weight, easy fabrication, and low cost.

Antennas are grouped generally into resonant-type antennas and non-resonant-type antennas. When a resonant-type antenna acts at its resonant frequency, almost all power of the resonant antenna can be radiated from the antenna. However, when the receiving or transmitting frequency is different from the resonant frequency, the received or transmitted power cannot be delivered or radiated efficiently. Because of this, the resonant antenna is used by connecting many antennas of different resonating frequencies to each other to cover a wide frequency range. On the other hand, the non-resonant antenna can cover a wide frequency range, but realizing high antenna efficiency in a wide frequency range is very difficult. Additionally, antennas having good frequency characteristics in a wide frequency range and high efficiency are usually large. Therefore, normal antennas are not adaptable to wireless devices using the UWB frequency range because the devices have to be small, light and low cost.

FIG. 16 shows an example of a prior art micro-strip antenna having a rectangular slot. A metal layer 111 is layered on an insulation substrate 110. A rectangular slot 112 is formed in the metal layer 111. The metal layer 111 is connected to a transmission line 114 via a pin 113 inserted through the substrate 110. Transmission power is fed from a transmission circuit (not shown) connected to the transmission line 114 to the metal layer 111. When receiving an electric wave, the electric wave is received by the metal layer 111, and the signal is transmitted to a receiving circuit (not shown) connected to the transmission line 114 (see, for example, the microstrip antenna described in non-patent document 8 discussed below).

The following are references to related art. Prior art microstrip antennas are described in non-patent documents [1–6]. Prior art slot antennas are described in non-patent documents [7–8].

[1] G. Kumar and K. C. Gupta, "Directly coupled multi resonator wide-band microstrip antenna," *IEEE Trans. Antennas Propagation*, vol. 33, pp. 588–593, June 1985.

[2] K. L. Wong and W. S. Hsu, "Broadband triangular microstrip antenna with U-shaped slot," *Elec. Lett.*, vol. 33, pp. 2085–2087, 1997.

[3] F. Yang, X. X. Zhang, X. Ye, Y. Rahmat-Samii, "Wide-band E-shaped patch antenna for wireless communication," *IEEE Trans. Antennas Propagation*, vol. 49, pp. 1094–1100, July 2001.

[4] A. K. Shackelford, K. F. Lee, and K. M. Luk, "Design of small-size wide-bandwidth microstrip-patch antenna," *IEEE Antennas Propagation Magz.*, vol. 45, pp. 75–83, February 2003.

[5] J. Y. Chiou, J. Y. Sze, K. L. Wong, "A broad-band CPW-fed strip-loaded square slot antenna," *IEEE Trans. Antennas Propagation*, vol. 51, pp. 719–721, April 2003.

[6] N. Herscovici, Z. Sipus, and D. Bonefacic, "Circularly polarized single-fed wide-band microstrip patch," *IEEE Trans. Antennas Propagation*, vol. 51, pp. 1277–1280, June 2003.

[7] H. Iwasaki, "A circularly polarized small-size microstrip antenna with a cross slot," IEEE Trans. Antennas Propagation, vol. 44, pp. 1399–1401, October 1996.

[8] W. S. Chen, "Single-feed dual-frequency rectangular microstrip antenna with square slot," Electron. Lett., Vol. 34, pp. 231–232, February 1998.

Prior art microstrip antennas are disadvantageous because of their narrow-band frequency range. For an antenna to be suitable for UWB wireless devices, the antenna must be small, light, have wide bandwidth, and have low manufacturing costs. Traditional microstrip antennas, with or without slots, cannot not achieve these conditions.

SUMMARY OF THE INVENTION

One object of the present invention is to provide a slot antenna which is small in profile, light weight, portable, easy to fabricate, and has low distortion in a wide frequency range and an omni-directional pattern.

Another object of the present invention is to provide a novel slot antenna where the figure of the slot is a bow-tie shape, and with a very compact size to be used as an on-chip or stand-alone antenna for a UWB system. The proposed antenna can operate in UWB at a frequency range of 3.1–10.6 GHz.

The present invention comprises an insulation substrate, a metal layer on the insulation substrate, a slot formed in the metal layer and a feeding part connected to the metal layer. The shape of the slot is symmetric and has a bow-tie shape. When an x-y coordinate system is defined so that the origin is the center of the slot antenna, the y-axis is the symmetric line, and the x-axis is perpendicular to the y-axis, the width of the slot in the direction of the y-axis gradually increasing in proportion to the absolute value of the x-axis.

The slot antenna having the bow-tie shape slot can achieve a UWB frequency bandwidth of 3.1 GHz–10.6 GHz. Moreover, it has the attractive features of a tiny size usable in portable wireless devices, and low cost of fabrication. It also provides a characteristic of small VSWR in the UWB frequency range. The return loss of the slot antenna is around −7 dB in the entire frequency range of UWB.

The gain in the whole frequency range of UWB is more than 4 dBi. The 3D-radiation pattern of the slot antenna is almost uniform in the frequency range of UWB. Because of these characteristics, the bow-tie slot antenna of the present invention can be effective and used with excellent performance in wireless apparatuses using the UWB frequency range, with small transmission power and high data transmission rate.

DETAILED DESCRIPTION OF THE PREFERRED EMBODIMENTS

Figure 1:
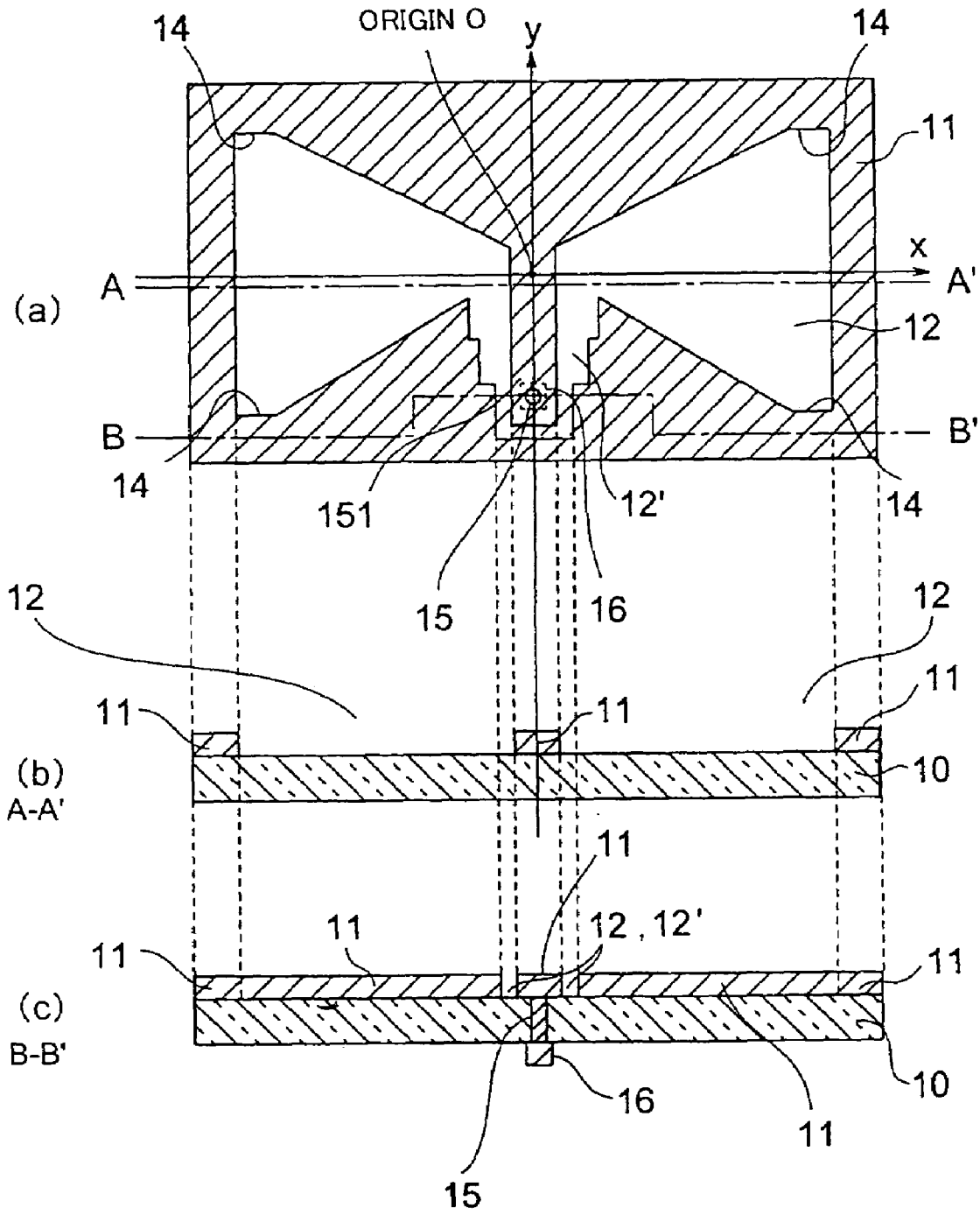
FIG. 1 is a drawing of an embodiment of the present invention.

FIG. 1 is an embodiment of the slot antenna according to the present invention. FIG. 1(*a*) is a plane view of the slot antenna. FIG. 1(*b*) is a cross sectional view cut at A–A' of the slot antenna. FIG. 1(*c*) is a cross sectional view cut at B–B' of the slot antenna.

A metal layer 11 in FIG. 1 is layered on an insulation substrate 10. The substrate 10 is composed of, for example, Teflon or FR-4. The metal layer 11 is comprised of one of Cu, Al, Au, or Pt for example. A slot is formed in the metal layer 11. The figure of the slot 12 is like a bow-tie shape as shown in FIG. 1(*a*), and made inside the slot is an extension part 151 extending from a side of the slot antenna. As shown in FIG. 1, slot 12' is narrowed step by step along the extension part 151. Narrowing it by three steps is an example. More steps or fewer steps are possible to narrow the slot, or the narrowing is possible. Four cut portions 14 are formed at each pointed edge of the slot 12. The cut portions 14 improve the characteristics of the slot antenna such as the VSWR characteristic. A feeding part 16 is comprised on the back side of the surfaces of substrate 10. The feeding part 16 is made of metal chosen from, for example, Cu, Al, Au, Ag or Pt. The feeding part 16 and the metal layer 11 are connected to each other via the through-hole of the substrate 10. A metal of the same type as the metal layer 11 is layered on the inner wall of the through-hole 15, and the through-hole is filled with the same insulator as the substrate 10 or a different insulator from the substrate 10. A pin is inserted in the hole 15 to connect the metal layer 11 to the feeding part 16, as another example of the structure of the through-hole. The location of the through-hole is set near the end of the extension part 151 to make the slot antenna match with the feeding part 16.

A rectangular x-y coordinate is defined as shown on FIG. 1(*a*). The figure of the slot is symmetry of the y-axis, and an origin is defined at the center of the slot antenna on the y-axis. The width of the slot 12 in the direction of the y-axis is gradually enlarged in proportion to enlargement of the absolute value of the x-axis.

The shape of the slot 12 is formed to be a bow-tie shape as shown in FIG. 1, and symmetric of the y-axis. The through-hole 15 is made near an end of the extension part 151 on the symmetry line. The slot antenna is connected to the feeding part 16 via the through-hole 15. The portion of the slot 12' adjacent to the extension part 151 is narrowed step by step along the extension part 151. The feeding part 16 is connected to a transmission circuit or a receiving circuit of a wireless device (not shown). Electric power fed from the transmission circuit to the metal layer 11 is radiated in the air. Electric power of radio wave is received by the metal layer 11 and transmitted to the receiving circuit connected to the feeding part 16.

Preferred embodiments of the present invention achieve a slot antenna having excellent antenna characteristics in the ultra wide frequency band of UWB because of the slot bow-tie shape and the gradually narrowed slot along the extension part 151. Moreover, the best impedance matching can be accomplished easily by adjusting the through-hole location on the y axis. The slot antenna according to preferred embodiments of the present invention has profiles of low height, light weight, small size, easy fabrication, and low cost, so that the slot antenna according to such preferred embodiments of the present invention can be used in almost all portable wireless devices, including UWB systems with simple structures.

Figure 2A:
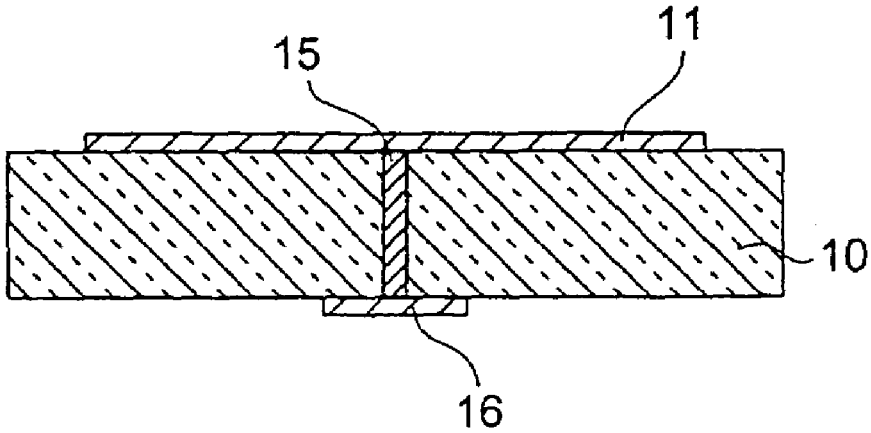
FIG. 2A is a drawing showing the through-hole according to an embodiment of the present invention.
Figure 2B:
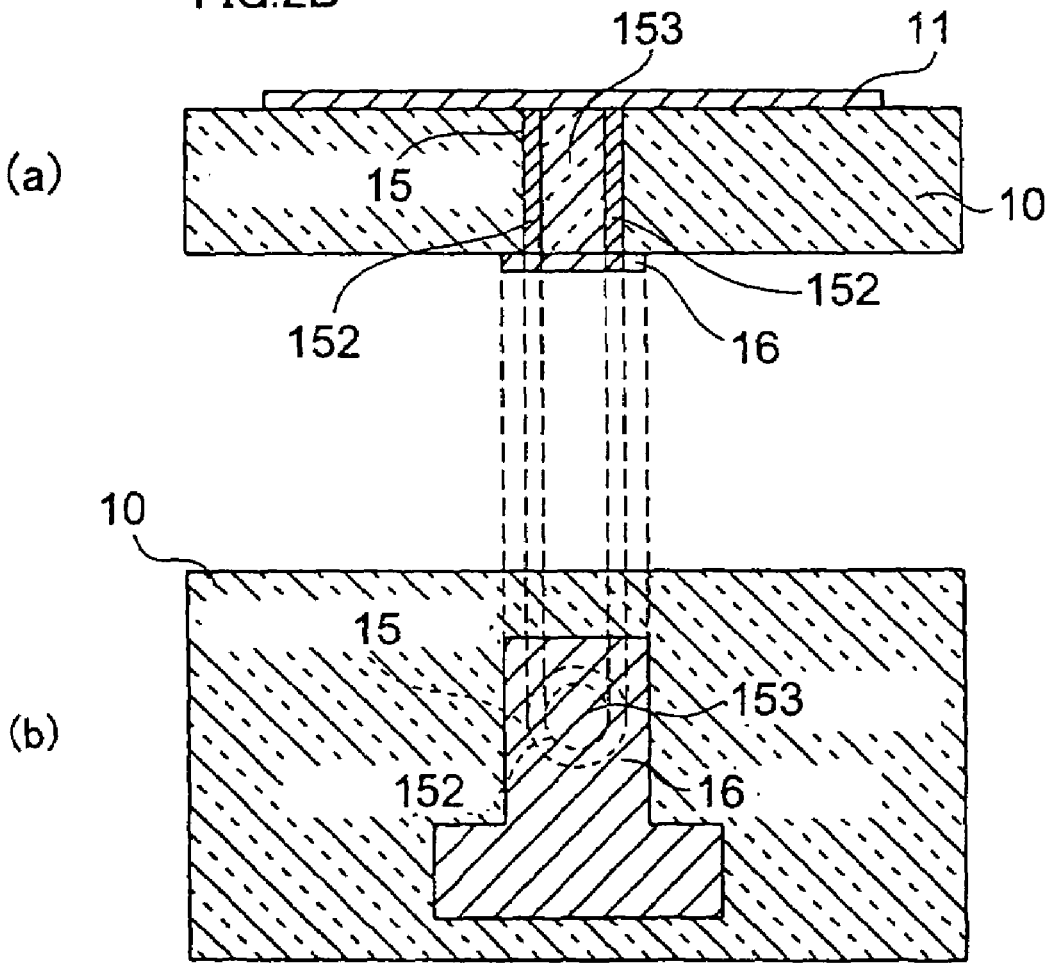
FIG. 2B is a drawing of another example of the through-hole according to an embodiment of the present invention.

FIG. 2A and FIG. 2B are embodiments of the through-hole connecting the metal layer 11 and the feeding part 16. FIG. 2A is a structure of through-hole formed by an electric conductive pin plugged in the substrate 10. The material of the pin is chosen from, for example, Cu, Al, Au, Ag or Pt. FIG. 2B(a) is a cross sectional view of the substrate 10, and FIG. 2B(b) is a plane view of the backside of the substrate 10. In FIG. 2B(a), an electrically conductive film 152 is deposited on the inner wall of the through-hole 15 and insulator 153 is filled in the hole.

Figure 3:
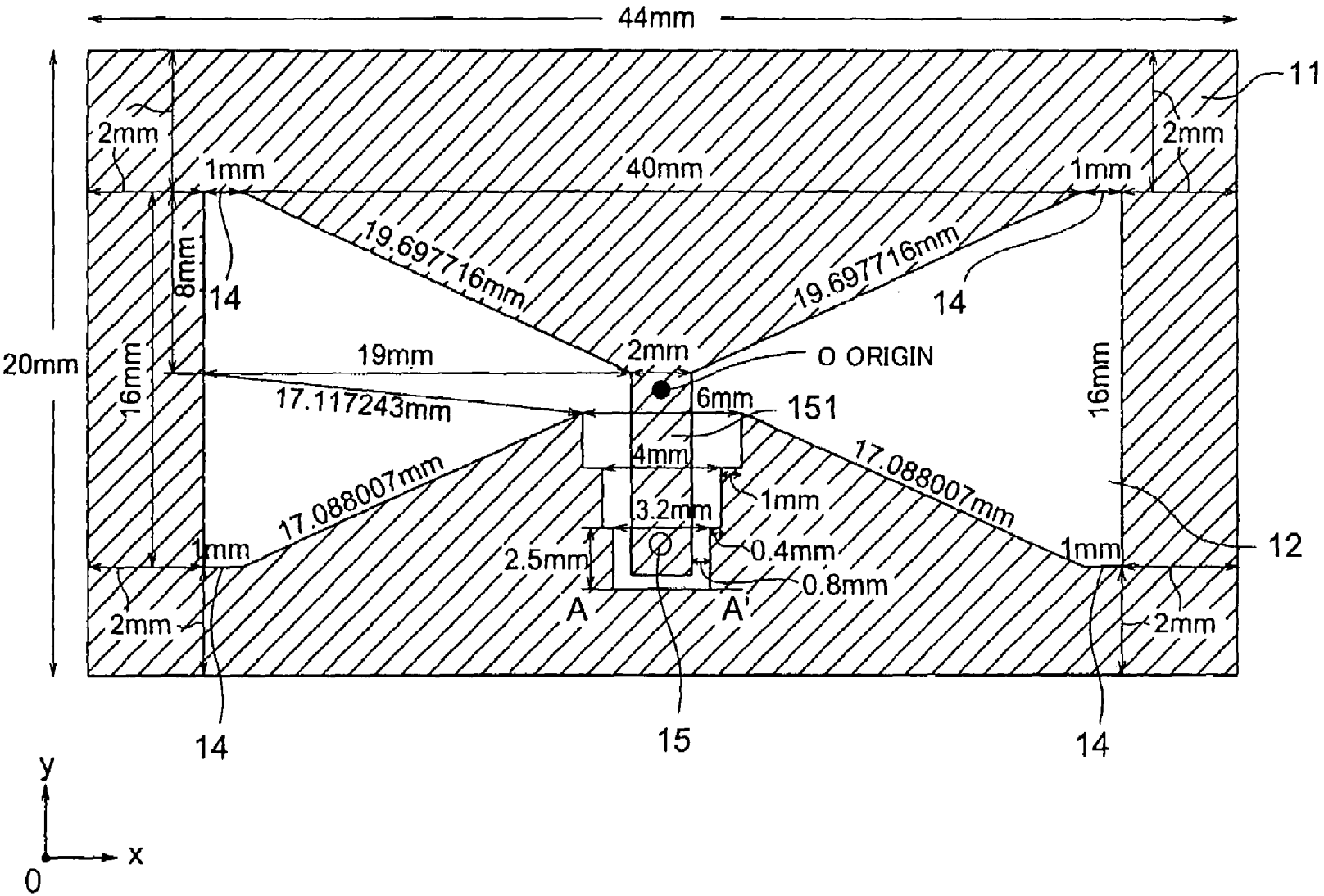
FIG. 3 is a drawing of another example of a slot antenna according to an embodiment of the present invention.

FIG. 3 is another example of a slot antenna according to an embodiment of the present invention. The outer form of the metal layer 11 is a rectangle of 20 mm×44 mm. The outer form of metal layer 11 is 44 mm×20 mm. The width of the slot 12 is 40 mm, and the longitudinal length of the slot is 16 mm. The slot antenna is symmetric with respect to the y-axis. An origin O of the x-y coordinate system is defined as the center of the rectangle of the outer lines of metal layer 11.

The through-hole 15 is formed on the y-axis and near the end of the extension part 151 extending into slot 12. The extension part 151 with a width of 2 mm×a length of 8 mm and the feeding part 16 are connected with the through-hole 15. The distances between the sides along the extension part 151 are 6 mm, 4 mm and 3.2 mm. The smallest width of the slot along the extension part 151 is 0.8 mm. The length of the cut portions 14 made at the pointed edges of the slot is 1 mm. The feeding part 16 and the through-hole 15 are explained in detail referring to FIG. 4.

The substrate 10 shown in FIG. 2 of the slot antenna according to an embodiment of the present invention is made of Teflon of thickness h=0.46 mm, permittivity $å_r$=2.17, and loss tangent tan ä=0.0006. The metallic layer 11 is copper of 0.018 mm thickness. The pattern of slot 12 is made, for example, by photo-etching the copper film layered on the substrate. The copper layer of the substrate is eliminated by photo-etching techniques to make the slot pattern. Additionally, the slot pattern can be made by printing electric-conductive paste of copper on the substrate.

The feeding part of Cu can be made, for example, by printing electric-conducting paste containing copper. The feeding part may also be made by photo-etching copper film layered on the substrate. The feeding part 16 is copper of 0.018 mm thickness. For the substrate 10, in addition to Teflon, various kinds of other materials can be used such as FR-4. Parameters like permittivity, loss tan ä, the thickness of the substrate, size, etc. are determined according to antenna size and antenna characteristics.

Figure 4:
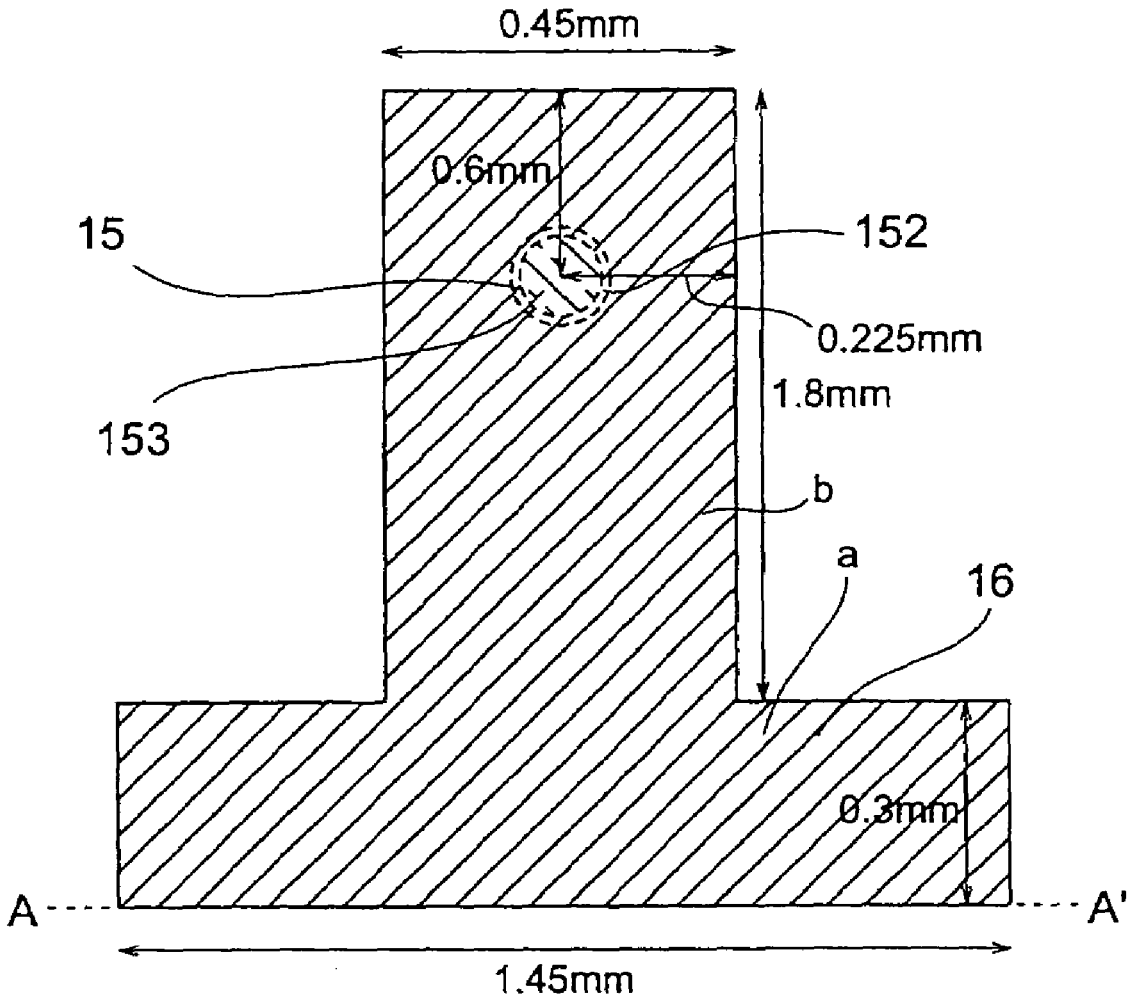
FIG. 4 is a drawing of another example of a through-hole and feeding part according to an embodiment of the present invention.

FIG. 4 is an example of feeding part 16 and the through-hole location of the slot antenna according to an embodiment of the present invention. The feeding part 16 is formed on the back side of the substrate 10. The lower part of the slot (A–A') (shown in FIG. 3) on the front side of substrate 10 is aligned to a side of feed point line A–A' on the back side of the substrate 10 in FIG. 4.

The feeding part 16 is a T-shape transmission line as shown in FIG. 4. The feeding part is T shaped for impedance matching with a 50-ohm connector. The width of the T-shape is decided to have impedance of 50 ohms to connect to a connector (not shown). The length of longitudinal part b of the T shape is designed to impedance match with the slot antenna on the front side of the substrate 10. The feeding part 16 is connected to the metal layer 11 by the copper layer 152 on the inner wall of the through-hole 15. The through-hole 15 is plugged with an insulation material 153, which is, for example, the same material as the substrate 10 such as Teflon or FR-4.

FIG. 5–FIG. 15 show antenna characteristics of the designed slot antenna shown in FIG. 3 and FIG. 4. The simulation results have been obtained from two different software programs, Ansoft Designer and HFSS (High Frequency Structure Simulator). Because the results of the simulators are the same, the obtained results appear to be accurate.

Figure 5:
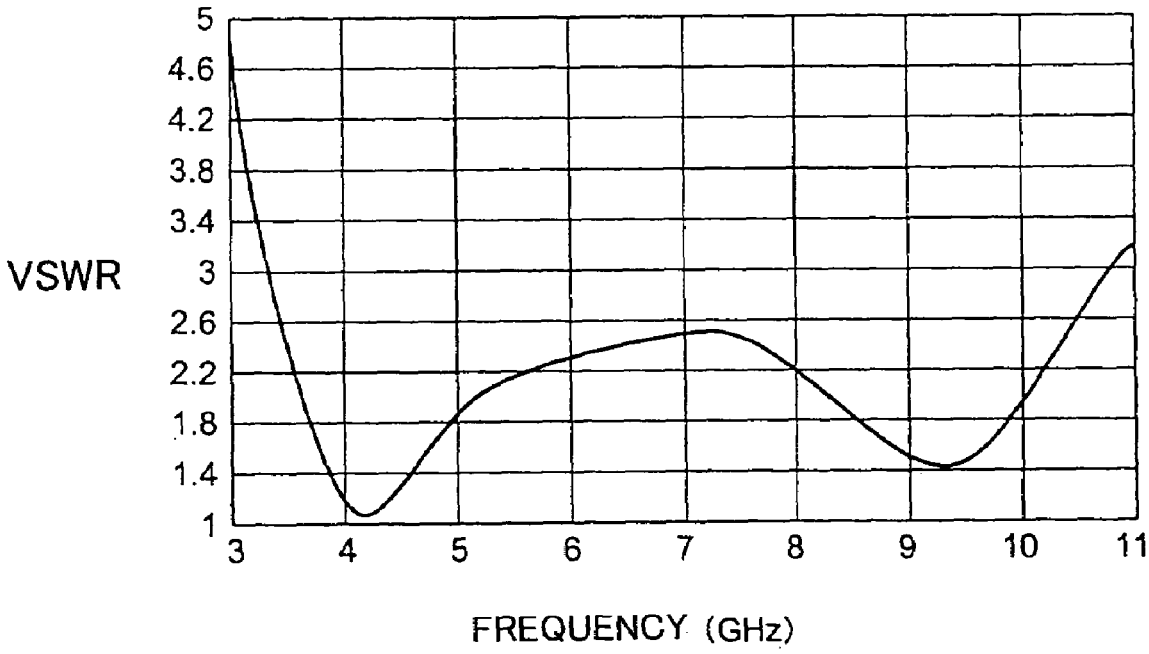
FIG. 5 is a drawing showing frequency characteristics of VSWR in an embodiment of the slot antenna according to the present invention.

FIG. 5 is VSWR characteristics in the entire frequency band from 3.5 GHz to 10.6 GHz. As shown in FIG. 5, the designed antenna has VSWR less than 2.5:1 from frequency of 3.5–10.6 GHz.

Figure 6:
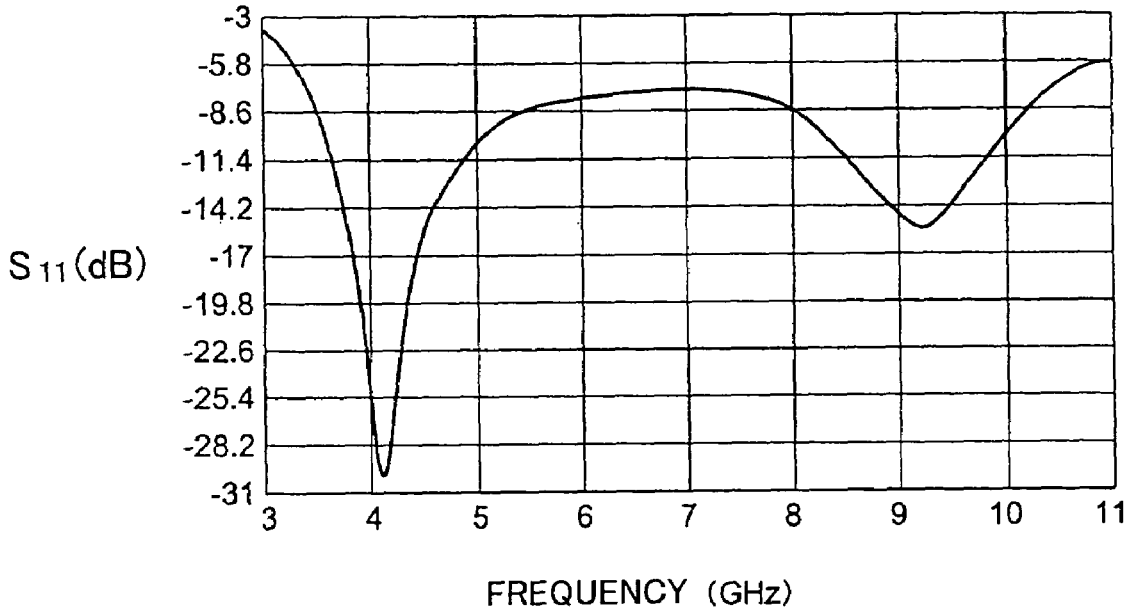
FIG. 6 is a drawing showing frequency characteristics of return loss in an embodiment of the slot antenna according to the present invention.

FIG. 6 is return loss characteristic in the entire frequency band from 3.5 GHz to 10.6 GHz. As shown in FIG. 6, the designed antenna has a return loss of −7 dB in the entire frequency range from 3.5 GHz to 10.6 GHz.

Figure 7:
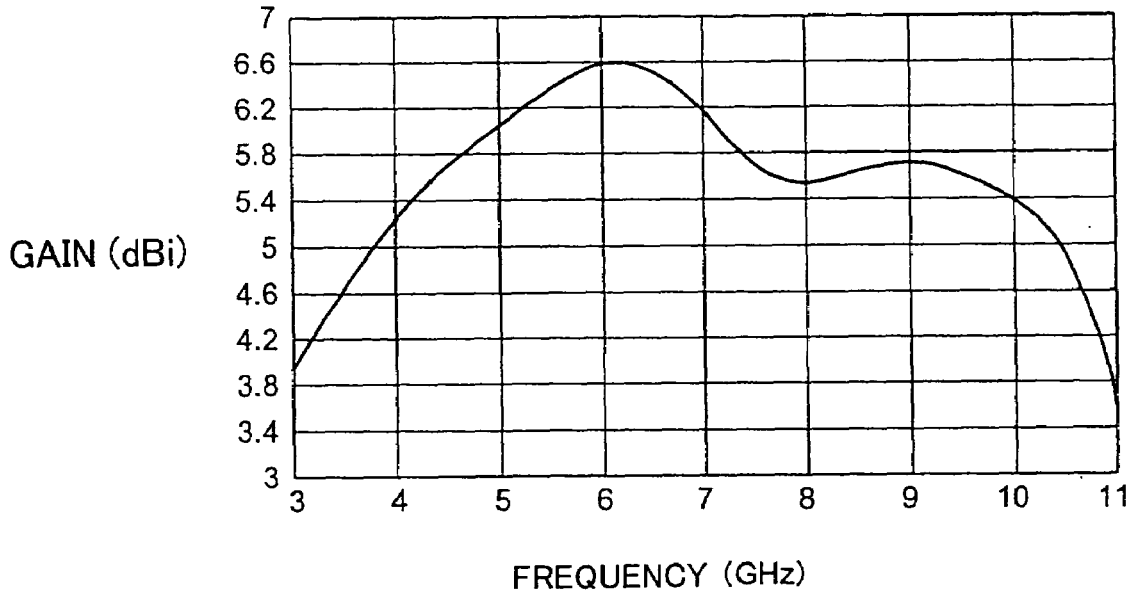
FIG. 7 is a drawing showing frequency characteristics of gain in an embodiment of the slot antenna according to the present invention.

FIG. 7 is gain characteristics in the entire frequency band from 3.5 GHz to 10.6 GHz. As shown in FIG. 7, the designed antenna achieves more than 4 dBi gain in the entire frequency from 3.5 GHz to 10.6 GHz.

Figure 8:
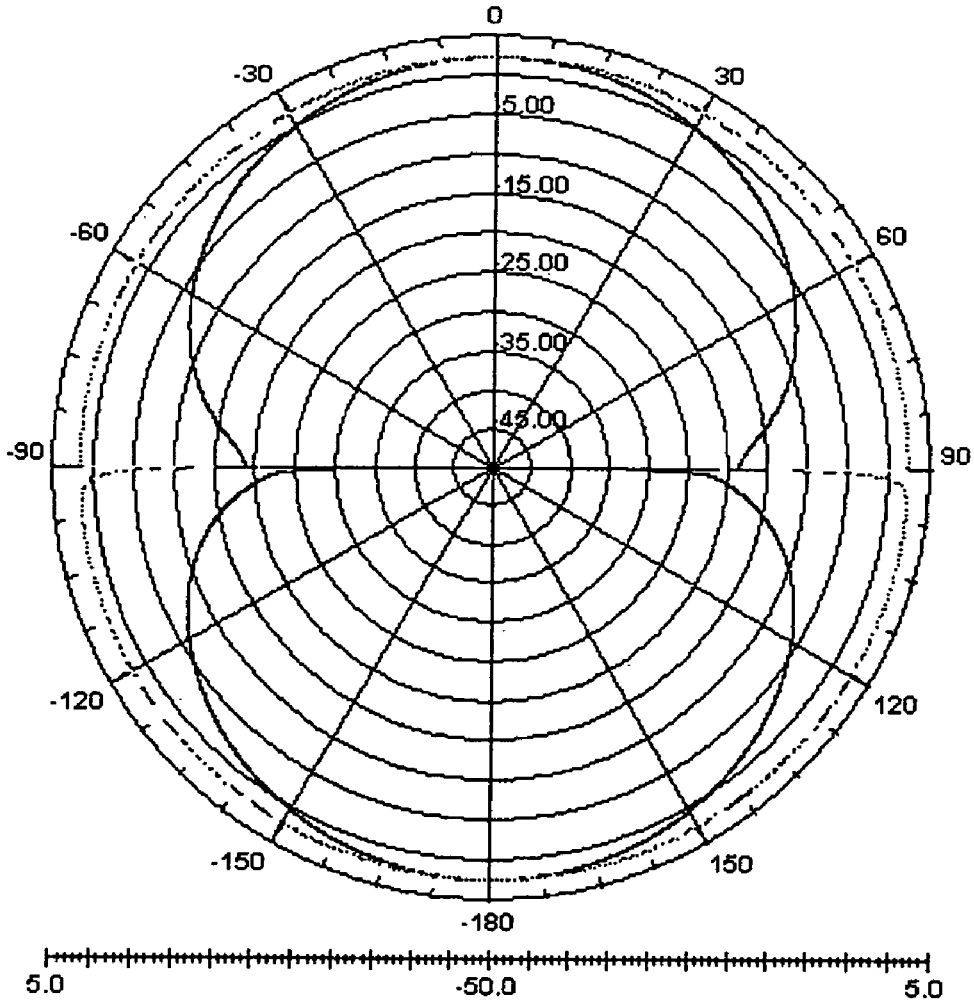
FIG. 8 is a drawing showing radiation characteristics of frequency 4 GHz in an embodiment according to the slot antenna of the present invention.
Figure 9:
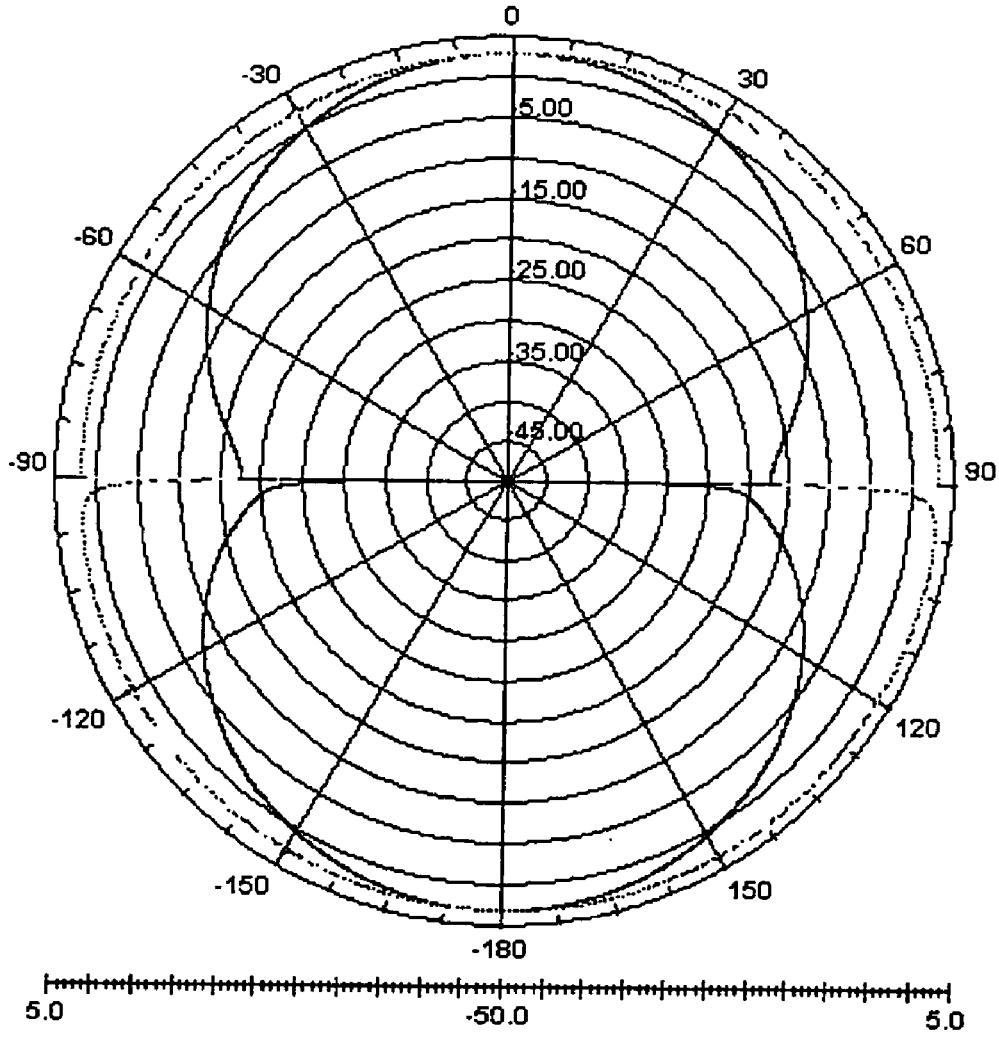
FIG. 9 is a drawing showing radiation characteristics of frequency 5 GHz in an embodiment of the slot antenna according to the present invention.
Figure 10:
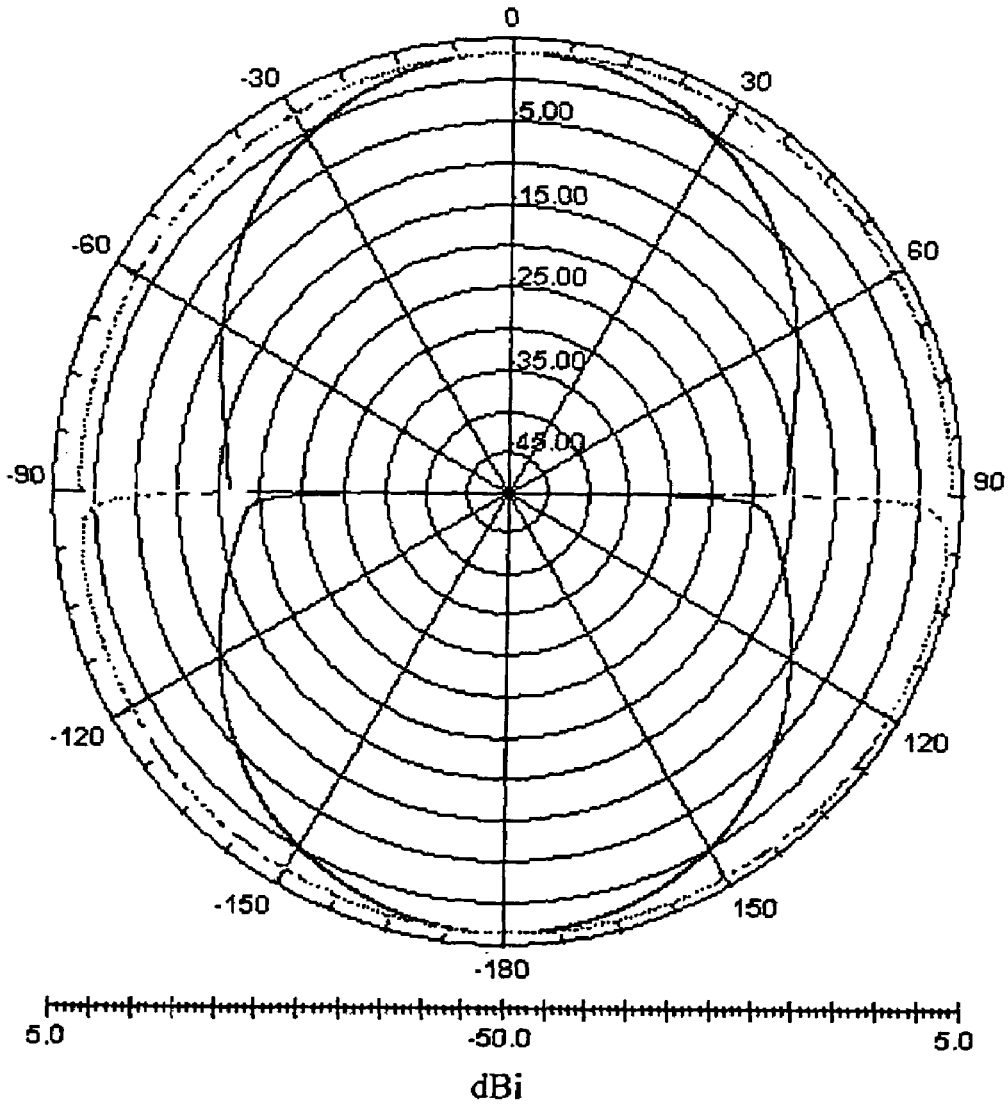
FIG. 10 is a drawing showing radiation characteristics of frequency 6 GHz in an embodiment of the slot antenna according to the present invention.
Figure 11:
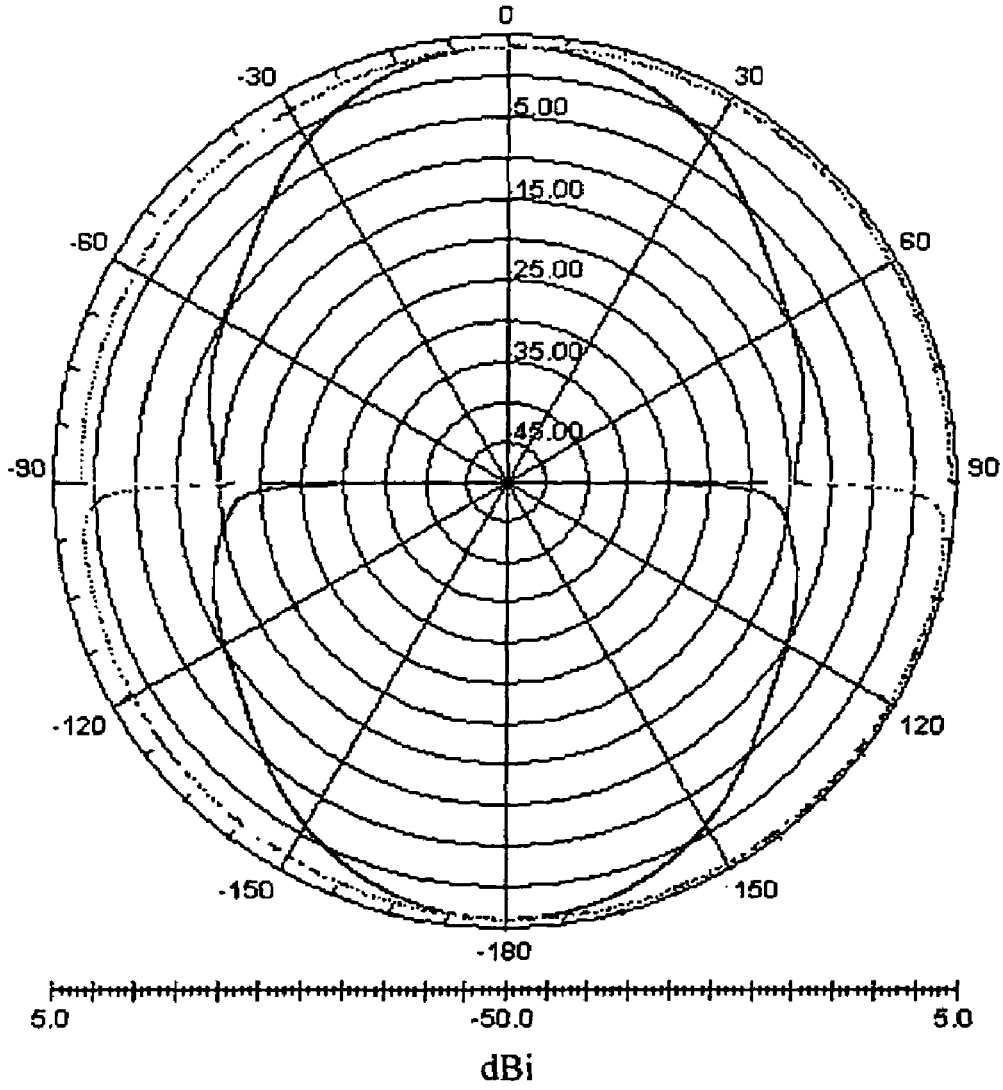
FIG. 11 is a drawing showing radiation characteristics of frequency 7 GHz in an embodiment of the slot antenna according to the present invention.
Figure 12:
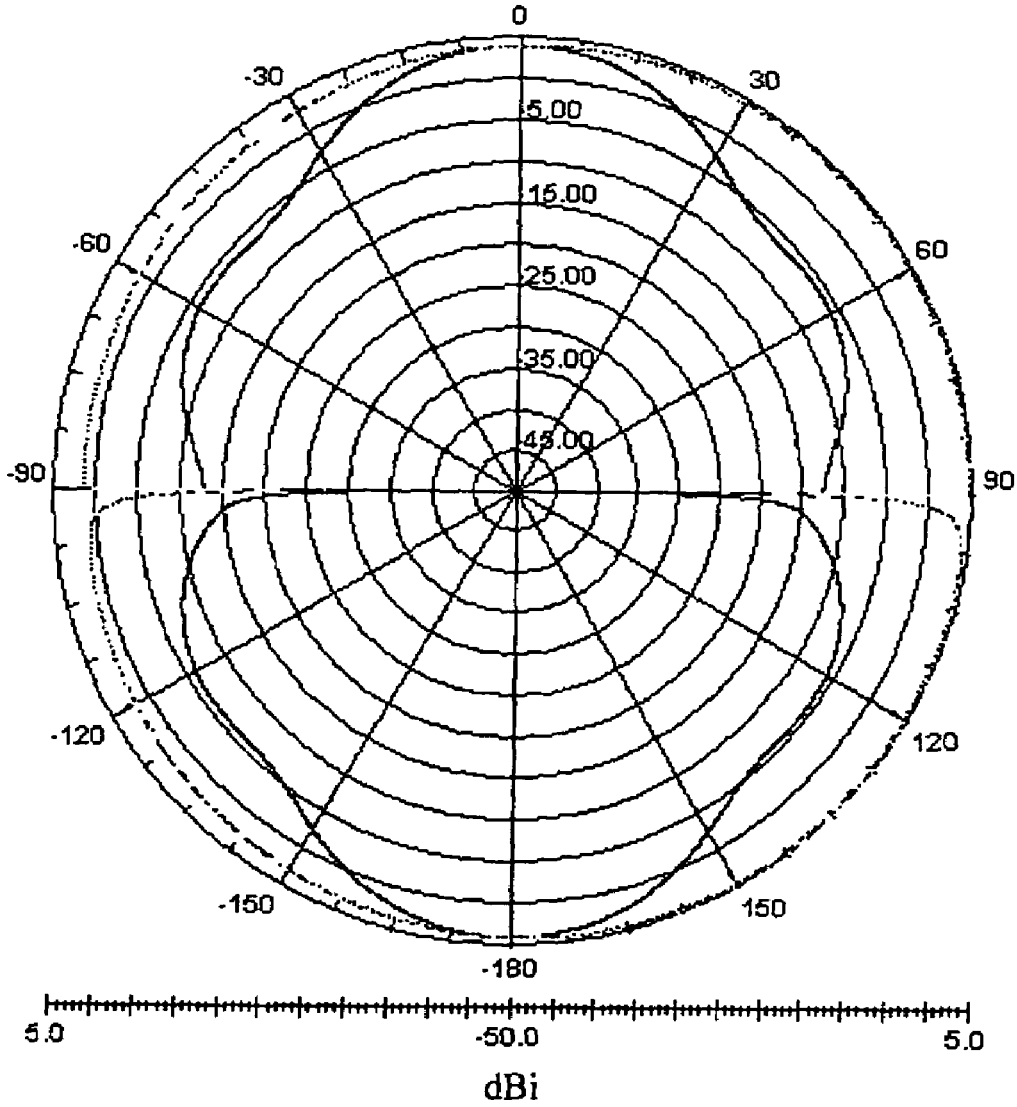
FIG. 12 is a drawing showing radiation characteristics of frequency 8 GHz in an embodiment of the slot antenna according to the present invention.
Figure 13:
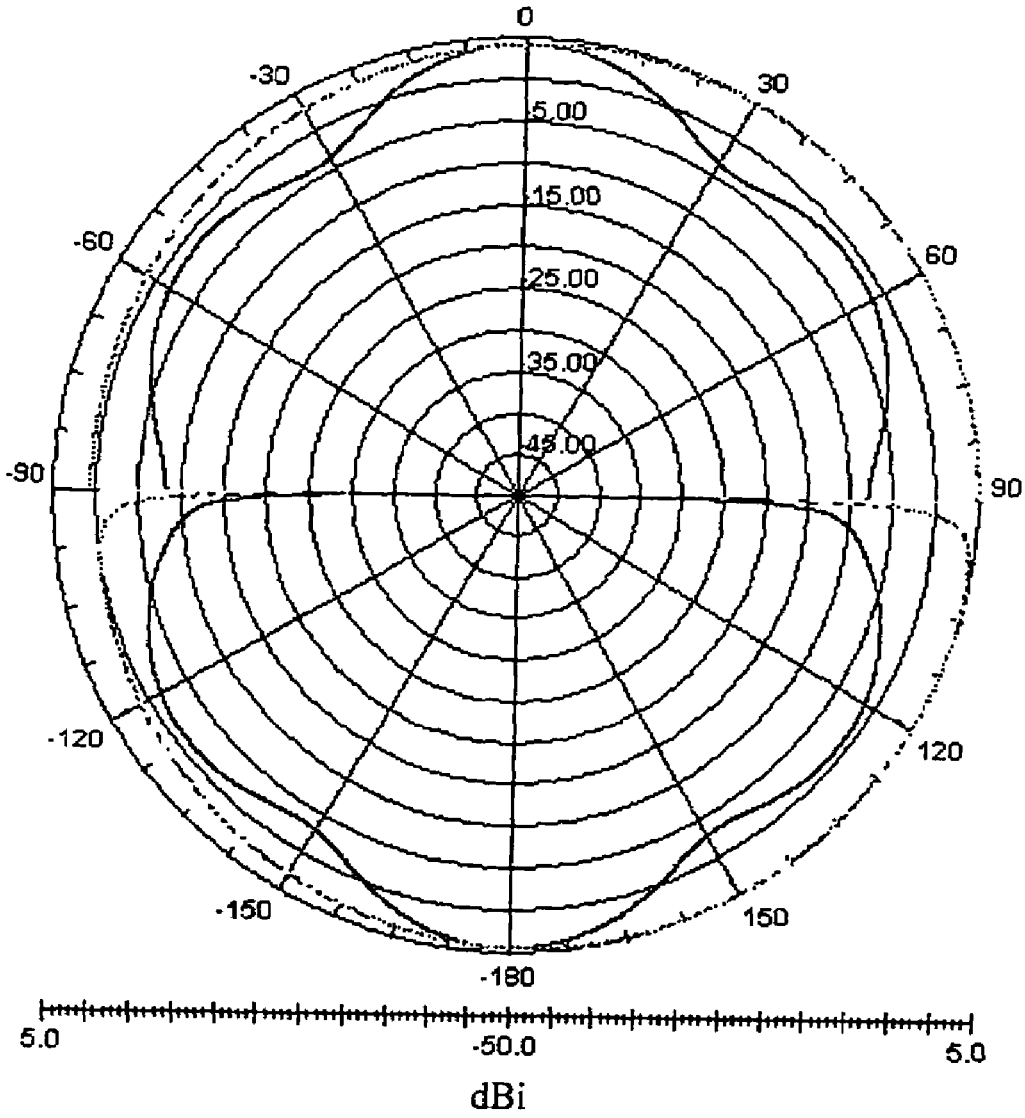
FIG. 13 is a drawing showing radiation characteristics of frequency 9 GHz in an embodiment of the slot antenna according to the present invention.
Figure 14:
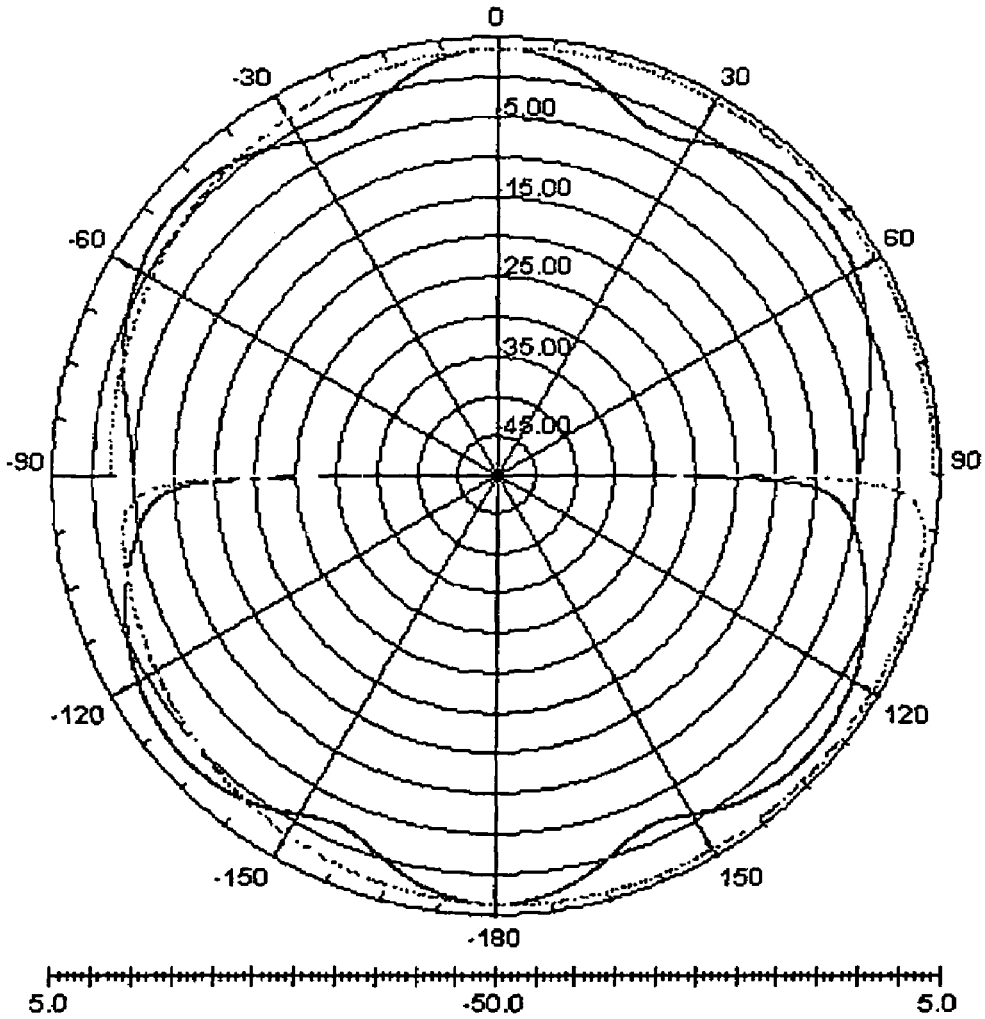
FIG. 14 is a drawing showing radiation characteristics of frequency 10 GHz in an embodiment of the slot antenna according to the present invention.

FIGS. 8–14 show radiation patterns at 4, 5, 6, 7, 8, 9, and 10 GHz at ö=0° and ö=90°. In FIGS. 8–14 real lines are ö=0° and dot lines are ö=90°. FIG. 8 is the radiation pattern of 4 GHz. FIG. 9 is the radiation pattern of 5 GHz. FIG. 10 is the radiation pattern of 6 GHz. FIG. 11 is the radiation pattern of 7 GHz. FIG. 12 is the radiation pattern of 8 GHz. FIG. 13 is the radiation pattern of 9 GHz. FIG. 14 is the radiation pattern of 10 GHz.

The radiation patterns of frequency from 4 GHz to 10 GHz are almost the same patterns. The results prove that the slot antenna of the present invention is very effective for use with UWB wireless devices with high data rates and low power densities.

Figure 15:
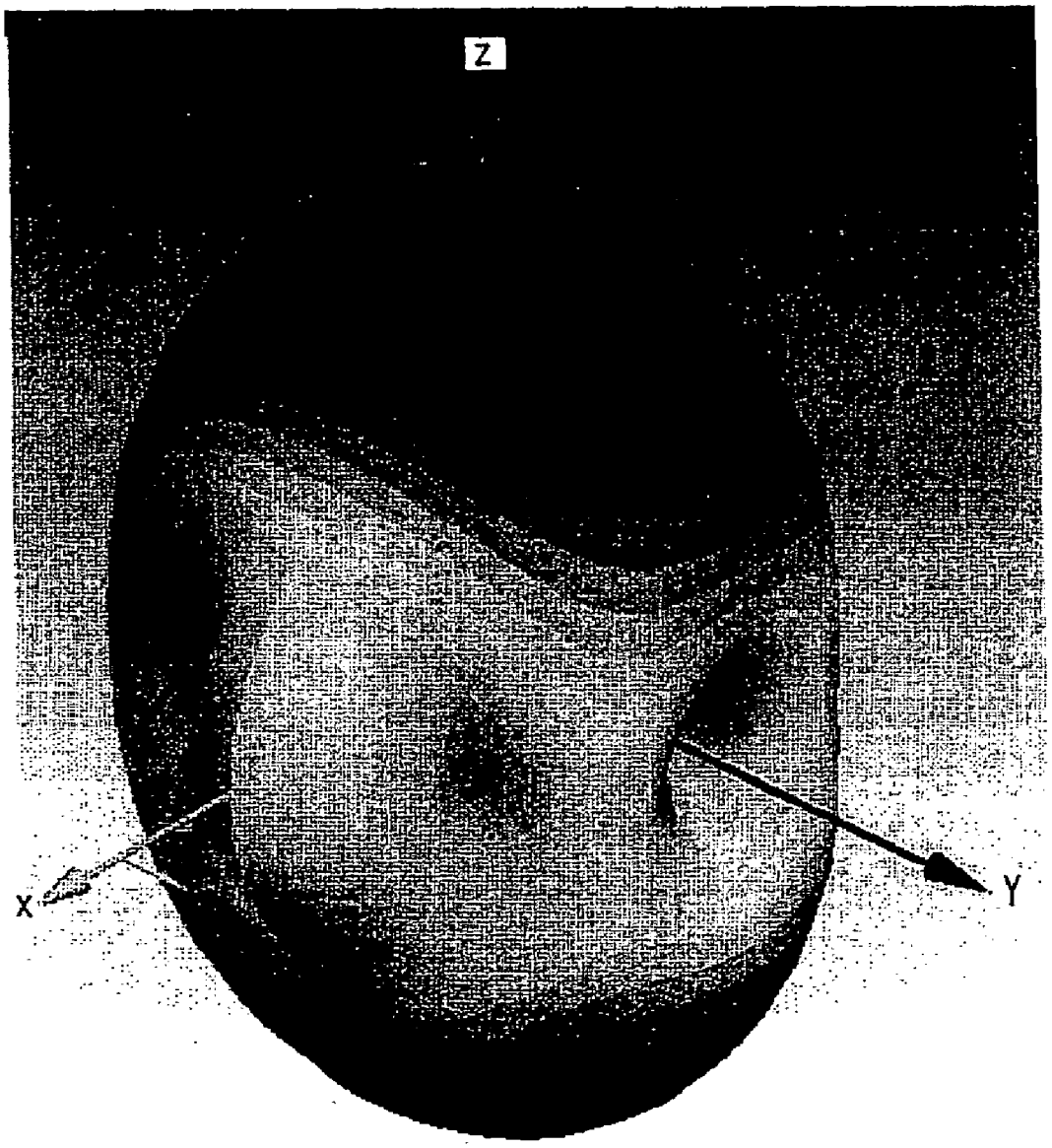
FIG. 15 is a drawing showing the three-dimensional radiation pattern at frequency 6.9 GHz of an embodiment of the slot antenna according to the present invention.
Figure 16:
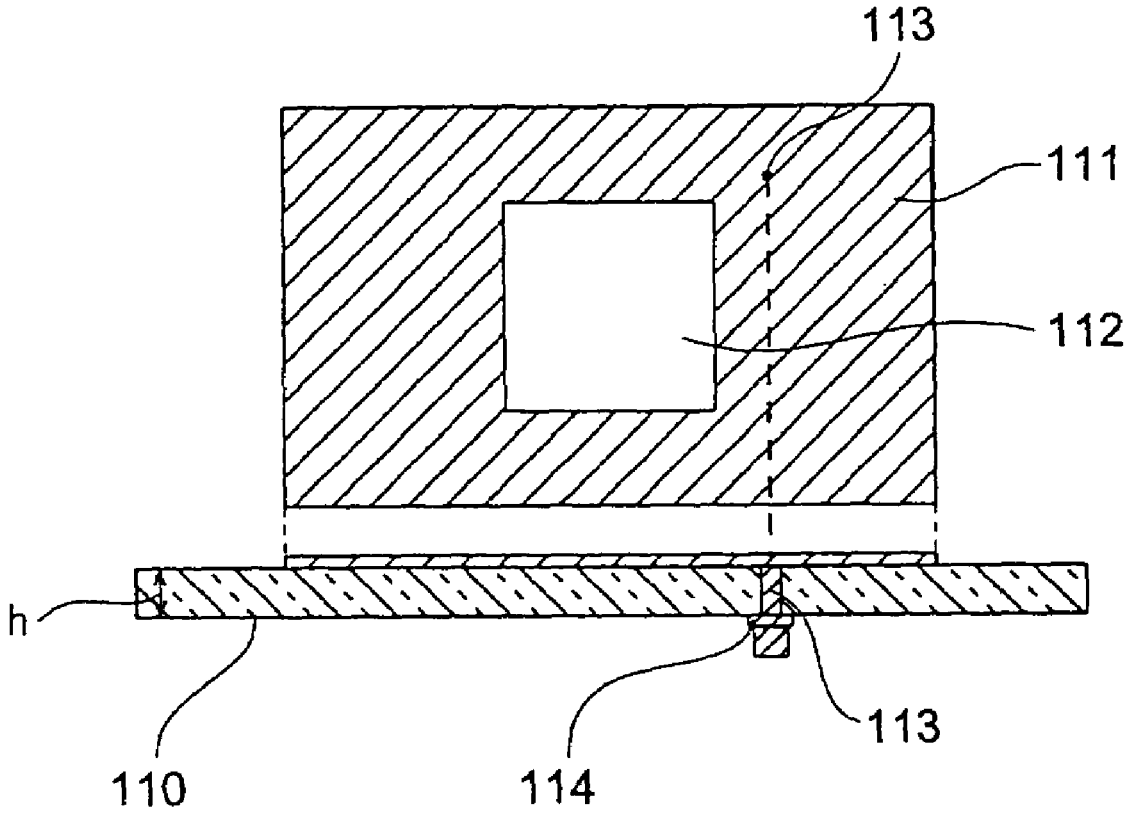
FIG.16 PRIOR ART
FIG. 16 is a drawing of a prior art slot antenna.

FIG. 15 is a three-dimensional radiation pattern according to embodiments of the present invention. The origin of the axis is the same as that defined in FIG. 3. The z axis is defined perpendicular to the x-y plane at the origin. The radiation pattern is uniform in space in three dimensions. This pattern proves that the slot antenna of such embodiments of the present invention is excellent and effective for use in UWB wireless communication systems.

These and other embodiments and objects are achieved in accordance with the inventions set forth in the claims and their equivalents.

What is claimed is:

1. A slot antenna comprising:

an insulation substrate;

a metal layer on the insulation substrate; and a feeding part connected to the metal layer, wherein the metal layer has a slot, the slot is symmetric with respect to a centerline, when an x-y coordinate system is defined on the metal layer so that the y-axis is the centerline, the origin is the center of the slot antenna, and the x-axis through the origin is perpendicular to the y-axis, the width of a first portion of the slot in the direction of the y-axis is gradually enlarged in proportion to the absolute value of the x-axis, and an extension part extends on the centerline from a side of the slot antenna through the center of the slot antenna, the metal layer of the slot antenna is formed on a front side of the insulation substrate, the feeding part is formed on a back side of the insulation substrate, the insulation substrate has a hole from the front side to the back side, an electric conducting layer is formed on the inner surface of the hole or an electric conductive pin is inserted in the hole, and the feeding part is connected to the metal layer by the electric conductiing layer or by the electric conductive pin.

2. A slot antenna comprising:

and insulation substrate;

a metal layer on the insulation substrate; and a feeding part connected to the metal layer, wherein the metal layer has a slot, the slot is symmetric with respect to a centerline, when an x-y coordinate system is defined on the metal layer so that the y-axis is the centerline, the origin is the center of the slot antenna, and the x-axis through the origin is perpendicular to the y-axis, the width of a first portion of the slot in the direction of the y-axis is gradually enlarged in proportion to the absolute value of the x-axis, an extension part extends on the centerline from a side of the slot antenna through the center of the slot antenna, the shape of the slots is a bow-tie type, the feeding part is connected at an end of the extension part, the metal layer of the slot antenna is formed on a front side of the insulation substrate;

the feeding part is formed on a back side of the insulation substrate;

the insulation substrate has a hole from the front side to the back side;

an electric conducting layer is formed on the inner surface of the hole or an electric conductive pin is inserted in the hole; and the feeding part is connected to the metal layer by the electric conductive layer or by the electric conductive pin.

3. A slot antenna of comprising:

an insulation substrate;

a metal layer on the insulation substrate; and a feeding part connected to the metal layer, wherein the metal layer has a slot, the slot is symmetric with respect to a centerline, when an x-y coordinate system is defined on the metal layer so that the y-axis is the centerline, the origin is the center of the slot antenna, and the x-axis through the origin is perpendicular to the y-axis, the width of a first portion of the slot in the direction of the y-axis is gradually enlarged in proportion to the absolute value of the x-axis, an extension part extends on the centerline from a side of the antenna through the center of the slot antenna, and a cut portion is at each of the sides of the first portion of the slot parallel to the x-axis.

4. A slot antenna comprising:

an insulation substrate;

a metal layer on the insulation substrate; and a feeding part connected to the metal layer, wherein the metal layer has a slot, the slot is symmetric with respect to a centerline, when an x-y coordinate system is defined on the metal layer so that the y-axis is the centerline, the origin is the center of the slot antenna, and the x-axis through the origin is perpendicular to the y-axis, the width of the first portion of the slot in the direction if the y-axis is gradually enlarged in proportion to the absolute value of the x-axis.

and extension part extends on the centerline from a side of the slot antenna through the center of the slot antenna, and a second portion of the slot surrounds sections of the extension part.

5. The slot antenna of claim 4, wherein the second portion of the slot surrounds the bottom section of the extension part; and the second portion of the slot is narrowest at the bottom section of the extension part.

6. The slot antenna comprising:

an insulation substrate;

a metal layer on the insulation substrate; and a feeding part connected to the metal layer, wherein the metal layer has a slot, the slot is symmetric with respect to a centerline, when an x-y coordinate system is defined on the metal layer so that the y-axis is the centerline, the origin is the center of the slot antenna, and the x-axis through the origin is perpendicular to the y-axis, the width of a first portion of the slot in the direction of the y-axis is gradually enlarged in proportion to the absolute value of the x-axis, an extension part extends on the centerline from a side of the slot antenna through the center of the slot antenna, and a second portion of the slot surrounds sections of the extension part.

* * * * *

UNITED STATES PATENT AND TRADEMARK OFFICE

CERTIFICATE OF CORRECTION

PATENT NO. : 7,193,576 B2
APPLICATION NO. : 11/023454
DATED : March 20, 2007
INVENTOR(S) : Kamya Yekeh Yazdandoost et al.

It is certified that error appears in the above-identified patent and that said Letters Patent is hereby corrected as shown below:

Column 6, Line 42, after “x-axis,” delete “and”.

Column 6, Line 55, change “conductiing” to --conducting--.

Column 6, Line 59, change “and” to --an--.

Column 7, Line 6, change “slots” to --slot--.

Column 7, Line 10, after “substrate” change “;” to --,--.

Column 7, Line 12, after “substrate” change “;” to --,--.

Column 7, Line 14, after “side” change “;” to --,--.

Column 7, Line 17, after “hole” change “;” to --,--.

Column 7, Line 21, after “antenna” delete “of”.

Column 7, Line 35, before “antenna through” insert --slot--.

Column 7, Line 36, after “each” insert --end--.

Column 8, Line 7, after “width of” change “the” to --a--.

Column 8, Line 8, change “if” to --of--.

Column 8, Line 10, change “x-axis.” to --x-axis,--.

Column 8, Line 11, change “and” to --an--.

Column 8, Line 21, change “The” to --A--.

Column 8, Lines 30-31, after “width of” delete “a first portion of”.

UNITED STATES PATENT AND TRADEMARK OFFICE

CERTIFICATE OF CORRECTION

PATENT NO. : 7,193,576 B2
APPLICATION NO. : 11/023454
DATED : March 20, 2007
INVENTOR(S) : Kamya Yekeh Yazdandoost et al.

It is certified that error appears in the above-identified patent and that said Letters Patent is hereby corrected as shown below:

Column 8, Lines 34-38, after "x-axis," change "an extension part extends on the centerline from a side of the slot antenna through the center of the slot antenna, and a second portion of the slot surrounds sections of the extension part." to --and the slot includes a cut portion at each end of the sides of the slot parallel to the x-axis.--.

Signed and Sealed this

First Day of April, 2008

JON W. DUDAS
*Director of the United States Patent and Trademark Office*